US005919078A

United States Patent [19]

Cassidy

[11] Patent Number: 5,919,078

[45] Date of Patent: Jul. 6, 1999

[54] TOY VACUUM CLEANER

[75] Inventor: Paul Michael Cassidy, St Annes on Sea, United Kingdom

[73] Assignee: Cassidy Brothers, plc, Blackpool, United Kingdom

[21] Appl. No.: 09/131,297

[22] Filed: Aug. 10, 1998

[30] Foreign Application Priority Data

Aug. 28, 1997 [GB] United Kingdom ..... 9718260
Jan. 9, 1998 [GB] United Kingdom ..... 9800503

[51] Int. Cl.[6] ..... A63H 3/52; A63H 33/40; G09F 19/00

[52] U.S. Cl. ..... 446/479; 446/144; 446/178; D21/526; 40/409

[58] Field of Search ..... 446/479, 482, 446/483, 491, 176, 178, 144; 434/260; D21/526, 525; D32/22, 21, 24; 40/409, 410

[56] References Cited

U.S. PATENT DOCUMENTS

D. 201,814 8/1965 Rockwell ..... D21/526
D. 274,446 6/1984 McIntosh et al. ..... D21/526
D. 280,000 8/1985 Klawitter ..... D21/526
D. 295,770 5/1988 Hilton ..... D21/526
D. 315,756 3/1991 Pape et al. .
D. 325,407 4/1992 Norton .
D. 361,803 8/1995 Houry et al. .
2,248,390 7/1941 Schaad ..... 446/479 X
2,543,606 2/1951 Solomon et al. ..... 40/409 X
4,215,500 8/1980 Sharp ..... 40/409
4,993,986 2/1991 Bloomfield ..... 446/140
5,194,032 3/1993 Garfinkel .
5,313,727 5/1994 Murray, Jr. ..... 40/410
5,426,877 6/1995 Lin ..... 40/409
5,794,364 8/1998 Richmond ..... 446/176 X

*Primary Examiner*—D Neal Muir
*Attorney, Agent, or Firm*—Trapani & Molldrem

[57] ABSTRACT

A toy is intended to resemble a cyclone type vacuum cleaner. The toy vacuum cleaner includes a body comprising a cylindrical container which has a transparent cylindrical outer wall. A core extends axially into the container to define a space between itself and the outer wall. A fan assembly is mounted to close an open end of the container. A multiplicity of polystyrene beads are disposed within the space between the core and the outer wall. The fan assembly includes a fan rotor mounted substantially coaxially with the container, to be driven by a motor, whereby on activation of the motor, the fan causes a circulation of air within the container, which circulation causes the beads to move in approximately circular paths about the core.

16 Claims, 2 Drawing Sheets

TOY VACUUM CLEANER

BACKGROUND TO THE INVENTION

The present invention relates to toy vacuum cleaners, for example, to a toy vacuum cleaner intended to present a visual appearance resembling cyclonic vacuum cleaners as described in various patent applications of Dyson (r.t.m).

There is a substantial market for toys which imitate the appearance of actual domestic products. These toys are popular with children, because they allow children to imitate the actions of their parents and other adults.

In recent years, cyclone vacuum cleaners patented and manufactured by Dyson have achieved substantial popularity. These cleaners have excellent appearance, a striking feature of which is that material which has been gathered by the cleaner can be seen to circulate in a high speed air stream within a transparent plastic collection vessel.

It is an aim of the invention to provide a toy vacuum cleaner which imitates the distinctive appearance of a cyclone vacuum cleaner.

SUMMARY OF THE INVENTION

According to the invention, there is provided a toy vacuum cleaner which includes a body comprising a cylindrical container which has a transparent cylindrical outer wall, a core extending axially into the container to define a space between itself and the outer wall, a fan assembly mounted on the container, and a multiplicity of particles within the space between the core and the outer wall, the fan assembly including a fan mounted substantially coaxially with the container, to be driven by a motor, whereby on activation of the motor, the fan causes a circulation of air within the container, which circulation causes the particles to move in approximately circular paths about the core.

The particles while in motion resemble dust inside a cyclone vacuum cleaner sufficiently closely for the purpose of entertaining a child, in a system which is simple enough to permit low-cost mass-production for sale as a toy.

The container and the core may be conveniently formed as a one-piece moulding (e.g. an injection moulding) of plastic material. At least part of the core is preferably coloured and opaque to provide a background against which the particles can be seen clearly. In embodiments according to the last-preceding sentence, a coating may be applied to the material of the core to render it coloured and/or opaque. Preferably, such a coating is applied on a surface of the material of the core which does not come into contact with the particles, in order that it does not become worn or damaged through contact with the moving particles.

The particles can conveniently comprise beads of expanded polystyrene. The particles may be provided in an assortment of colours.

A toy vacuum cleaner embodying the invention typically further comprises a handle part secured to the body. Additionally, a base part may be secured to the body to resemble an upright vacuum cleaner, or a nozzle or hose part may be provided to resemble a cylinder vacuum cleaner.

Optionally, a toy vacuum cleaner embodying the invention may further comprise a container, and a suction assembly; in which the container is removably mountable within the body, such that an inlet of the container projects from the body, and such that an outlet of the container permits passage of air form the container into the body, the outlet being configured to block the passage of at least some solid objects from within the container; and in which the suction assembly is disposed to eject air from the body, thereby to cause air to flow into the container through the inlet of the container, and from the container into the body through the outlet of the container.

Thus, small objects can become entrained within the flow of air in the inlet to enter the container, wherein they become trapped though being unable to pass out of the container through the outlet.

The outlet may comprise a multiplicity of apertures formed in a wall of the container. Preferably, such apertures are formed in an upper wall such that solid material tends to fall away from them thereby to reduce the likelihood of their becoming blocked.

The suction assembly typically comprises a fan rotor driven by an electric motor. The fan may be contained within a duct, an inlet of which is disposed adjacent the outlet of the container.

DETAILED DESCRIPTION OF A PREFERRED EMBODIMENT

Figure 1:
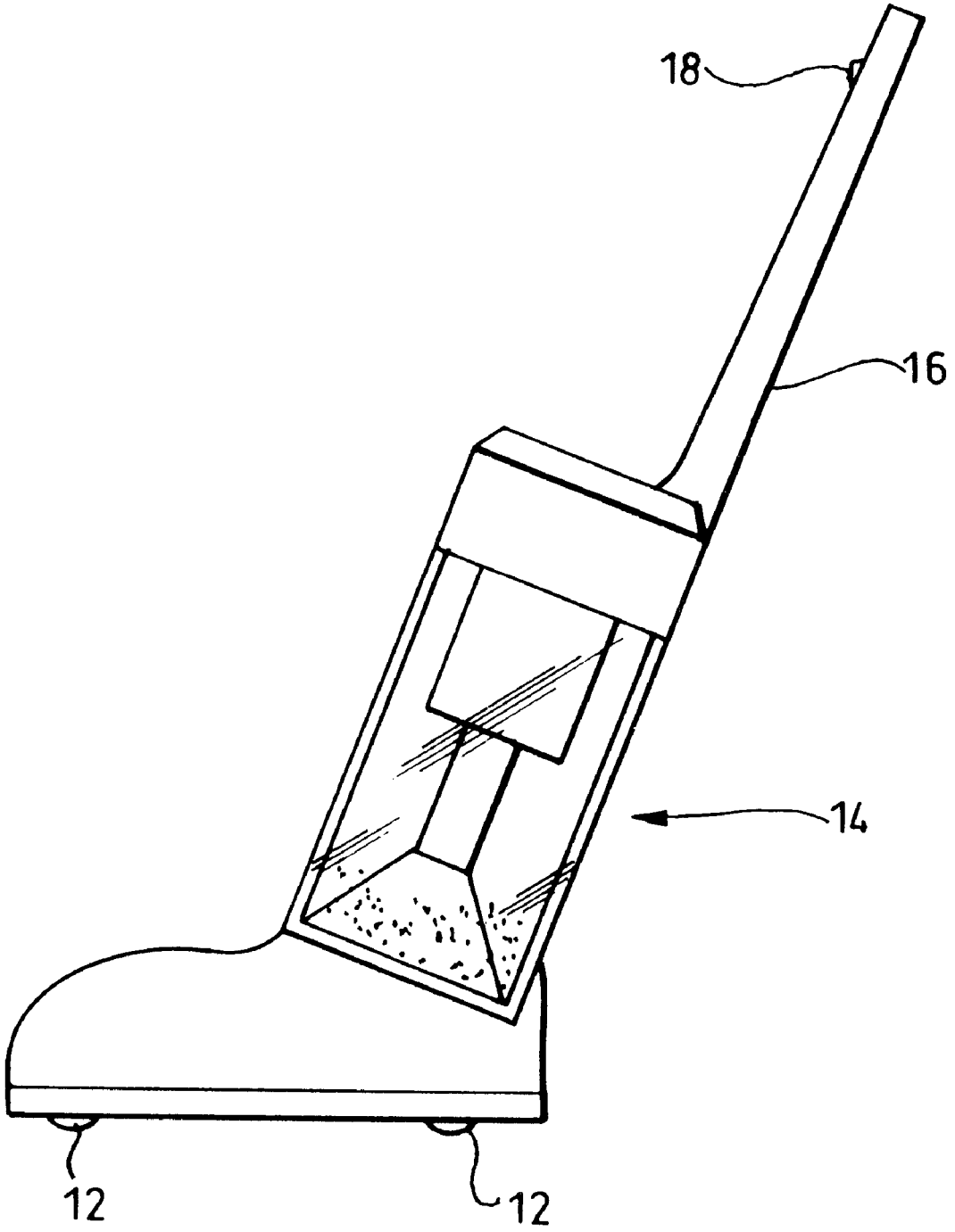
FIG. 1 shows a toy upright cleaner embodying the invention.

With reference to FIG. 1, a toy vacuum cleaner comprises a base part 10 having a plurality of wheels 12 on which it can travel over a surface, such as a floor.

A body 14 is secured to the base, to extend generally upwardly from it. A handle part 16 projects from the body 14, the handle part 16 being disposed to enable a child to push or pull the toy over across, for example, a carpeted floor. An electrical switch 18 is carried on the handle part 16. The function of the switch will be explained below.

Figure 2:
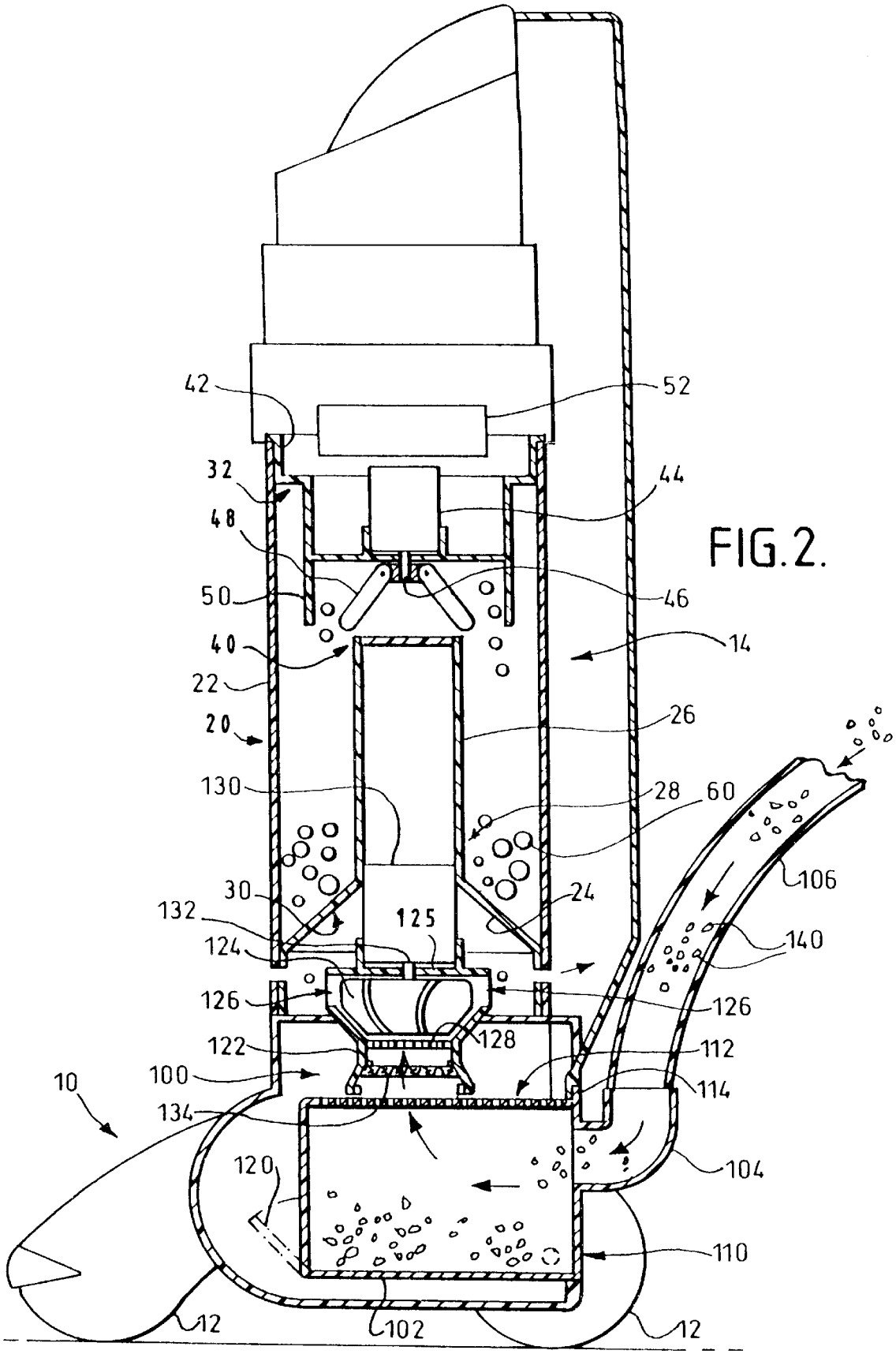
FIG. 2 is an enlarged cross-sectional view of a body of the toy vacuum cleaner of FIG. 1.

With reference now to FIG. 2, the body 16 comprises a container 20. The container 20 is formed as a moulding of transparent plastic material. The container 20 has a cylindrical outer wall 22 which is open at an upper end. At a lower end, the container has a frusto-conical inwardly projecting wall region 24 which extends axially within the container 20. At its upper end, a cylindrical wall region 26 extends from the frusto-conical region 24. The outer wall 22, the frusto-conical wall region 24, and the cylindrical wall region 26 are each constituted by regions of the container 20. The frusto-conical wall region 24 and the cylindrical wall region 26 together constitute a core 28 of the container.

Inner surfaces, at 30, of the core 28 are coated with a layer of opaque yellow paint. Since the material of the container 20 is transparent, the core appears yellow in colour and opaque when viewed from outside the container 20.

An upper end of the cylindrical wall region 26 is formed as an open end, for ease of manufacture. A closure plug 32 is inserted into it and secured there to close any axial passage through the core 28.

The body further comprises a first fan assembly 40 mounted in the region of the upper end of the container 20. The first fan assembly 40 comprises a plastic housing 42 which is shaped and dimensioned to be a close fit within an upper end portion of the container 20, thereby to completely close an internal space within the container.

An first electric motor 44 is mounted in the housing. The first motor 44 has an output shaft 46 which extends axially downwardly from the housing into the space within the container 20. A first fan rotor 48 is carried on the output shaft 46, and is disposed close to the closure plug 32 above the core 28. The first fan rotor 48 is surrounded by a cylindrical depending skirt portion 50 of the housing 42.

The first fan rotor 48 has vanes which are disposed such that they predominantly cause an air stream to circulate around the core 28 rather than causing an axial flow of air.

Also mounted within the housing 32 is an electrical battery 52 suitable for powering the first motor 44. The battery 52 is connected to the first motor 44 through the switch 18, such that the first motor 44 can be turned on and off under control of the switch 18.

A multiplicity of expanded polystyrene beads 60 are disposed within the container. The beads 60 are coloured in an assortment of colours. When the first motor 44 is switched on, the swirling air flow generated by the first fan rotor 48 causes these beads 60 to circulate rapidly around the core 28. They are clearly visible against the yellow background provided by the coating, but because they are not in direct contact with the coating, no abrasion occurs between the beads 60 and the coating. The visual effect which occurs as the beads 60 circulate has been found to satisfactorily imitate a cyclone vacuum cleaner.

It will be appreciated that the beads 60 are permanently contained within the container 20 and do not need to be replenished.

A suction assembly 100 is contained within the base part 10.

The suction assembly 100 comprises a cuboidal container 102 of transparent plastic material contained within the base part 10. The container 102 comprises an inlet pipe 104 projecting from a first wall 110, to which inlet pipe 104 can be connected a flexible hose 106. The container 102 also has a peripheral flange 114 which extends from the circumference of the first wall 110. A second wall 112 of the container has a multiplicity of small apertures passing through it. An openable flap 120 is provided on a third wall of the container, which can be opened in order to remove from it any material contained within the container 102. The container 102 can be formed as a moulding of rigid plastic material, the apertures being formed integrally within the moulding.

The base part 10 has an aperture into which the container 102 can be received. The container 102 is disposed such that its first wall is open externally of the base part 10, and is held in place by readily-removable fasteners (not shown). The flange 114 abut an outer wall of the body 10 to form a simple air seal.

A duct 122 extends from within the base part 10 into the body 14. A first end of the duct 122 is disposed adjacent the second wall 112 of the container 102. The first end constitutes an air inlet of the duct 122. Within a lower part the body 14, and within the core 28, the duct 122 has an upper wall 124 and a plurality of radial air outlets 126. Radial air passages 126 are formed in the body 14 such that air emerging from the air outlets 126 can escape from the body 14.

A second motor 130 is carried on the upper wall 124. An output spindle 132 of the motor extends through the upper wall 125 into the duct 122. A second fan rotor 124 is carried on the spindle 132. The second motor 130 may be connected in parallel with the first motor 44 such that both motors operate together under control of the switch 18. Alternatively, separate switches and/or batteries may be provided for the two motors 44,130.

Between the second fan rotor 124 and the air inlet of the duct 122 there is disposed a grating 128. The grating is sufficiently open to allow passage of air through the duct 122, but has apertures which are too small to enable a child to touch the second fan rotor 124 with his or her fingers. A filter element 134 is disposed close to the air inlet of the duct 122 to trap any small particles, such as dust or ash.

The second fan rotor 124 is shaped such that rotation of it by the second motor 130 creates a flow of air within the duct 122, such that air enters through the first end of the duct 122 and is ejected through the air outlets 126. The effect of this is to reduce pressure within the base part 10, this in turn causing air to flow from the container 102, though the apertures in its second wall 112. This is turn gives rise to a flow of air though the hose 106 and the inlet pipe 104 into the container 102. This flow of air can be sufficiently strong to entrain small pieces of solid material 140. Such pieces 140 are carried into the container 102, and are deposited there, being unable to pass through the apertures in the second wall 112. The pieces 140 may be removed from the container 102 through the openable flap 120.

What is claimed is:

1. A toy vacuum cleaner comprising:

a body comprising a cylindrical container, which container has a transparent cylindrical outer wall, a core member extending axially into the container to define a space between itself and the outer wall, a fan assembly mounted on the container, and a multiplicity of particles within the space between the core member and the outer wall;

the fan assembly including a fan rotor and a motor mounted substantially coaxially with the container the fan rotor being carried on an output shaft of the motor to be driven by the motor, whereby on activation of the motor, the fan rotor causes a circulation of air within the container, which circulation causes the particles to move in approximately circular paths about the core member.

2. A toy vacuum cleaner according to claim 1 in which the container and the core member are formed as a one-piece moulding of plastic material.

3. A toy vacuum cleaner according to claim 1 in which at least part of the core member is coloured and opaque to provide a background against which the particles can be seen clearly.

4. A toy vacuum cleaner according to claim 3 having a coating applied to the material of the core member to render it coloured and/or opaque.

5. A toy vacuum cleaner according to claim 4 in which the coating is applied on a surface of the material of the core member which does not come into contact with the particles.

6. A toy vacuum cleaner according to claim 1 in which the particles comprise beads of expanded polystyrene.

7. A toy vacuum cleaner according to claim 1 in which the particles are provided in an assortment of colours.

8. A toy vacuum cleaner according to claim 1 further comprising a handle part secured to the body.

9. A toy vacuum cleaner according to claim 1 further comprising a base part secured to the body to resemble an upright vacuum cleaner.

10. A toy vacuum cleaner according to claim 1 further comprising a nozzle or hose part to resemble a hose of a vacuum cleaner.

11. A toy vacuum cleaner according to claim 1 further comprising a container, and a suction assembly; in which the container is removably mountable within the body, such that an inlet of the container projects from the body, and such that an outlet of the container permits passage of air from the container into the body, the outlet being configured to block the passage of at least some solid objects from within the container; and in which the suction assembly is disposed to eject air from the body, thereby to cause air to flow into the container through the inlet of the container, and from the container into the base through the outlet of the container.

12. A toy vacuum cleaner according to claim 11 in which the outlet comprises a multiplicity of apertures formed in a wall of the container.

13. A toy vacuum cleaner according to claim 12 in which the apertures are formed in an upper wall of the container.

14. A toy vacuum cleaner according to claim 11 characterised in that the suction assembly comprises a fan rotor driven by an electric motor.

15. A toy vacuum cleaner according to claim 1, in which the fan rotor includes means to generate a swirling air flow around the core member.

16. A toy vacuum cleaner according to claim 1, in which the space defined between the core member and the outer wall includes an annular space.

* * * * *